US009601817B2

(12) United States Patent
Kaesser

(10) Patent No.: US 9,601,817 B2
(45) Date of Patent: Mar. 21, 2017

(54) 30 GHZ IMUX DIELECTRIC FILTER HAVING DIELECTRICS INSERTED INTO RECEIVING SPACES AND HAVING A HORIZONTAL ORIENTATION

(71) Applicant: Tesat-Spacecom GmbH & Co. KG, Backnang (DE)

(72) Inventor: Tobias Kaesser, Stuttgart (DE)

(73) Assignee: Tesat-Spacecom GmbH & Co. KG, Backnang (DE)

( * ) Notice: Subject to any disclaimer, the term of this patent is extended or adjusted under 35 U.S.C. 154(b) by 29 days.

(21) Appl. No.: 14/535,119

(22) Filed: Nov. 6, 2014

(65) Prior Publication Data

US 2015/0123747 A1 May 7, 2015

(30) Foreign Application Priority Data

Nov. 6, 2013 (DE) ..... 10 2013 018 484

(51) Int. Cl.

| | |
|---|---|
| ***H01P 1/20*** | (2006.01) |
| ***H01P 1/208*** | (2006.01) |
| ***H01P 7/10*** | (2006.01) |
| ***H01P 3/16*** | (2006.01) |

(52) U.S. Cl.

CPC ..... *H01P 1/2084* (2013.01); *H01P 1/2002* (2013.01); *H01P 3/16* (2013.01); *H01P 7/10* (2013.01)

(58) Field of Classification Search

CPC ..... H01P 1/2084; H01P 1/2086; H01P 7/10

USPC ..... 333/202

See application file for complete search history.

(56) References Cited

U.S. PATENT DOCUMENTS

| | | | | |
|---|---|---|---|---|
| 5,608,363 | A * | 3/1997 | Cameron et al. | H01P 1/2084 333/202 |
| 6,320,484 | B1 | 11/2001 | Furuya et al. | |
| 6,535,086 | B1 * | 3/2003 | Liang et al. | H01P 1/205 333/219.1 |
| 2002/0041221 | A1 * | 4/2002 | Abdulnour | H01P 1/2084 333/202 |

FOREIGN PATENT DOCUMENTS

| | | |
|---|---|---|
| DE | 690 25 293 T2 | 8/1996 |
| DE | 60 2004 012 641 T2 | 4/2009 |
| EP | 0 432 729 A2 | 6/1991 |
| EP | 1 174 944 A2 | 1/2002 |
| EP | 1 372 212 A1 | 12/2003 |

OTHER PUBLICATIONS

European Search Report dated Mar. 9, 2015, with partial English translation (two (2) pages).

* cited by examiner

*Primary Examiner* — Benny Lee
(74) *Attorney, Agent, or Firm* — Crowell & Moring LLP

(57) ABSTRACT

A dielectric filter includes a receiving member with a plurality of receiving spaces and a cover. The cover is arranged to cover the receiving spaces in the receiving member. Each receiving space of the plurality of receiving spaces includes a rectangular cavity with a dielectric.

8 Claims, 4 Drawing Sheets

30 GHZ IMUX DIELECTRIC FILTER HAVING DIELECTRICS INSERTED INTO RECEIVING SPACES AND HAVING A HORIZONTAL ORIENTATION

FIELD OF THE INVENTION

The present application claims priority under 35 U.S.C. §119 to German application 10 2013 018 484.3, filed Nov. 6, 2013, the entire disclosure of which is herein expressly incorporated by reference.

Exemplary embodiments of the present invention relate to a dielectric filter comprising a plurality of dielectric resonators for a data transmission path, particularly for a satellite transmission link, and more particularly for a satellite radio uplink. More specifically, exemplary embodiments are directed to a dielectric filter for satellite transmission links operating in the Ka band transmission link in a frequency range of 17.7—21.2 GHz for the downlink and in a frequency range of 27.5-31 GHz for the uplink.

BACKGROUND OF THE INVENTION

Resonators can be used as a passive component of a filter in the radio transmission link. In practice filters almost always consist of several coupled resonators. As the signal frequency of the signal transmission on a radio link increases, the requirements of the filter change, in particular the structural and spatial requirements, as well as the requirements for the usable bandwidth of a filter changes. The usable bandwidth is that frequency bandwidth in which a filter response to a central frequency is constant or nearly constant.

Typically, such filters are designed as self-compensating components of a higher order and are for example used in input multiplexers (IMUX).

SUMMARY OF THE INVENTION

Exemplary embodiments of the present invention are directed to a filter, which provides a higher filter bandwidth for frequencies in the Ka band, especially for the uplink of the Ka band.

According to a first aspect, a dielectric filter has a receiving element with a plurality of receiving chambers and a cover. The cover is configured to cover the receiving chambers in the receiving element. Each receiving chamber of the plurality of receiving chambers is configured to accept a dielectric and includes a rectangular cavity.

A receiving chamber thus includes a resonator of the filter and the filter has a plurality of resonators. This substantially rectangular configuration of the resonator allows the dielectric filter to have a uniform or almost uniform functional performance over a wide bandwidth. For example, the response of the filter can remain substantially the same over a bandwidth of several hundred MHz.

The receiving member and the cover can be configured as one piece and consist of aluminum or an aluminum alloy, or may comprise aluminum or an aluminum alloy. In one exemplary embodiment, the receiving member and the cover may be silver-coated.

In other words, the receiving member forms a housing with receiving spaces in the form of cavities and the cover forms a cover for the housing.

The receiving spaces are rectangular. This means that the cavities shaped as such have six substantially flat-sided surfaces, whereby opposing side surfaces are the same size or identical, adjacent sides are different sizes or are shaped differently, i.e. the edge lengths of the edges of the receiving space are not all of equal length.

In one exemplary embodiment at least two opposing surfaces (the base surfaces) can be rectangular with various edge lengths of the base surface or square with the same length edges of the base surface.

The receiving space shaped as such for a dielectric enables an optimized course of the electric field lines through a dielectric arranged in the receiving chamber, so that the bandwidth of the filter is increased.

The angle of the receiving chamber can also be, for example, rounded or flattened, without such an adjustment of the shape of the receiving space changing anything fundamental about its rectangular shape.

A receiving space is a depression or a recess in a surface of the receiving member.

In one embodiment, the filter is a passive filter.

Use of the filter in satellite input multiplexers (IMUX) specifically requires that the filter have a high selectivity combined simultaneously with low distortion inside the passband. This is achieved because a number, typically 8, 10 or 12, of resonators are coupled such that using cross-coupling achieves both an increased slope and a flat profile of the transmission characteristic within the passband. And the resonators must have a low loss of performance (rating of at least several thousand) and low temperature drift; usually hollow conductor resonators made of silver-plated Invar (i.e., FeNi36 or 64FeNi) are used for this.

At the same time, for use on satellites, a low weight filter and a low construction volume are a decisive advantage. Therefore, at lower frequencies (Ka band downlink and lower) the dielectric technology is used predominantly. When using low-loss dielectric ceramics due to the shortening of the wavelength in the dielectric, miniaturization is achieved. At the same time this type of ceramics has this type of favorable temperature drift, so that the surrounding material no longer has to be Invar, but can be replaced by a lighter aluminum.

Especially in the Ka band uplink frequency range, it is required to produce such filters with a relatively high bandwidth of several hundred MHz. This also makes it necessary to ensure that the output resonator has a sufficiently interference-free area (from multiple filter bandwidths), and that the distribution of the electromagnetic field of the resonator is such that adjacent resonators can be strongly coupled in a filter structure.

All the above requirements are satisfied by the resonator or filter structure described here. With an operating frequency of, for example, 30 GHz the resonator quality factor is more than 5000 when using typical ceramics with a dielectric constant of 30. Couplings can be provided between adjacent resonators, as they are required for filter bandwidths up to 500 MHz; in this way coupling can be realized, i.e. while inspecting two coupled similar resonators with both the push-pull mode at a lower frequency and with the in-phase mode at a lower frequency.

The high frequency signal to be filtered has to be coupled into a resonator of the filter structure and decoupled from another resonator. Also in the specified wave guide (wave guide or coaxial technology) the signal has to be coupled to the mode of each resonator. There are standard techniques available for this.

According to an exemplary embodiment, the plurality of receiving spaces are arranged in two rows, whereby each row of receiving spaces extends in the longitudinal direction of the filter.

The receiving member or the filter is, in the longitudinal direction of the receiving member or filter, longer than in a transverse direction transverse to the longitudinal direction. The receiving spaces in a row are arranged adjacent to each other such that in the longitudinal direction of the receiving or filter several receiving members are next to each other, whereby two receiving spaces are arranged in the transverse direction of the receiving member or filter, which corresponds to 2 rows.

According to another exemplary embodiment, the plurality of receiving spaces is evenly distributed over a first and a second row.

This means that the first row and the second row have the same number of receiving spaces.

In an exemplary embodiment, the receiving member has ten receiving spaces, which are arranged in two rows of five receiving spaces.

According to another exemplary embodiment, a first receiving space and a second receiving space in a first row are adjacently arranged in the longitudinal direction of the filter in relation to each other. The first receiving space and the second receiving space are coupled together with a longitudinal coupling. The longitudinal coupling provides a coupling of adjacent receiving spaces in the longitudinal direction of the filter. And the longitudinal coupling is a material recess, which connects the cavities of the first space and second receiving spaces to each other.

The dimensions of the recess of the longitudinal coupling may thereby be at most identical to the dimensions of the side surfaces of the receiving spaces coupled via the longitudinal coupling. In a preferred embodiment, the dimensions of the cavity of the longitudinal coupling are less than the dimensions of the coupled side surfaces of the receiving spaces, for example, a quarter of the surface, a third of the surface, two-fifths of the surface or one half of the surface and all relationships among these data.

When viewed in the longitudinal direction of the filter, there is an opening extending through the partition between adjacent receiving spaces of the longitudinal coupling. This opening may in particular have a rectangular shape having a corner angle that can be rounded or flattened or not rounded or not flattened.

The so-designed longitudinal coupling of the adjacent receiving spaces facilitates the improved flow of the electrical field line by the dielectric that is arranged in the adjacent receiving spaces.

According to another exemplary embodiment, the receiving chambers in the receiving element comprise identical proportions.

According to another exemplary embodiment, a first receiving space in a first row of receiving spaces and a third receiving space in a second row of receiving spaces are adjacently arranged in the longitudinal direction of the filter so that the first receiving space and the third receiving space are not misaligned in the longitudinal direction of the filter.

In other words, two receiving spaces are respectively arranged at the same height in the first or second row in the longitudinal direction of the receiving member.

The longitudinal axis of the first receiving space and the third receiving space run transverse to the longitudinal direction of the filter and overlap, because the first receiving space and the third receiving space along the longitudinal direction of the receiving member should not misalign or they should align properly.

According to another exemplary embodiment the first and third receiving spaces are coupled via a cross-coupling with each other. The cross-coupling is similar to the longitudinal coupling and includes a recess connecting the cavities of the first and third receiving spaces with each other.

In other words, the cross-coupling is an opening transverse to the longitudinal direction of the filter between the receiving spaces that are well aligned or at the same height in the longitudinal direction of the filter.

The cross-coupling may also have a substantially rectangular cross-section and in a preferred embodiment is smaller than the side surfaces of the first and third receiving spaces that are coupled by the cross-coupling.

In an exemplary embodiment, the relationship of the dimensions of the longitudinal coupling to those of the longitudinally coupled side surfaces from the adjacent receiving spaces in the same row is greater than the ratio of the dimensions of the cross-coupling to those of the cross-coupled side surfaces from the adjacent receiving spaces in both rows.

The term "size" is interpreted to mean that of the corresponding surface, i.e. the size of the cross-section or the cross—or longitudinal coupling and the surface of the respectively coupled side surfaces.

According to another exemplary embodiment, the extension of a receiving space transverse to a longitudinal direction of the filter is greater than an extension of the receiving space along the longitudinal direction of the filter.

The longitudinal axis of receiving space extends transversely, and in particular perpendicularly to the longitudinal direction of the filter.

The longitudinal axis of a dielectric is arranged in the receiving space extends transversely and in particular perpendicular to the longitudinal direction of the filter.

According to another exemplary embodiment, the dielectric filter as described above and below, comprises a plurality of dielectrics. A dielectric is respectively disposed in each of the plurality of receiving chambers. The dielectric is rectangular and a longitudinal axis of the dielectric extends transversely to a longitudinal direction of the filter.

The dielectric may in particular comprise a dielectric ceramic with high permittivity or dielectric constant of, for example, 30.

The dielectric can be configured as a rectangular pillar or square pillar, wherein the base surface has identical side lengths or two identical and two with edge lengths that are different from the other two. The length of the dielectric member is thus larger than the largest edge length of the base surface.

In other words, the dielectric member comprises a substantially rectangular or square cross-section. And the corners can be rounded or flattened.

According to another exemplary embodiment, the longitudinal axis of the dielectric runs perpendicular to a longitudinal direction of the filter.

According to another exemplary embodiment, the longitudinal axis of a dielectric of a first receiving space and the longitudinal axis of a dielectric of a third receiving space run coaxially. Where the first receiving space in a first row of receiving spaces and the third receiving space in a second row of receiving spaces adjacently positioned transversely to the longitudinal direction of the filter to one another, so that the first receiving space and the third receiving space in the longitudinal direction of the filter are not misaligned.

If the dielectric members in this exemplary embodiment are respectively arranged centrally in the cavity of the receiving space, the center axis of the dielectric members in the first receiving space and in the third receiving space extend coaxially, i.e. these central axes overlap in such an exemplary embodiment.

According to another exemplary embodiment, dimensions of the cross-coupling are larger than the dimensions of the base of dielectric members.

BRIEF DESCRIPTION OF THE DRAWINGS

The exemplary embodiments of the invention will be more discussed in more detail below in connection with the drawings. The illustrations in the figures are schematic and not to scale. They show.

DETAILED DESCRIPTION OF THE INVENTION

Figure 1:
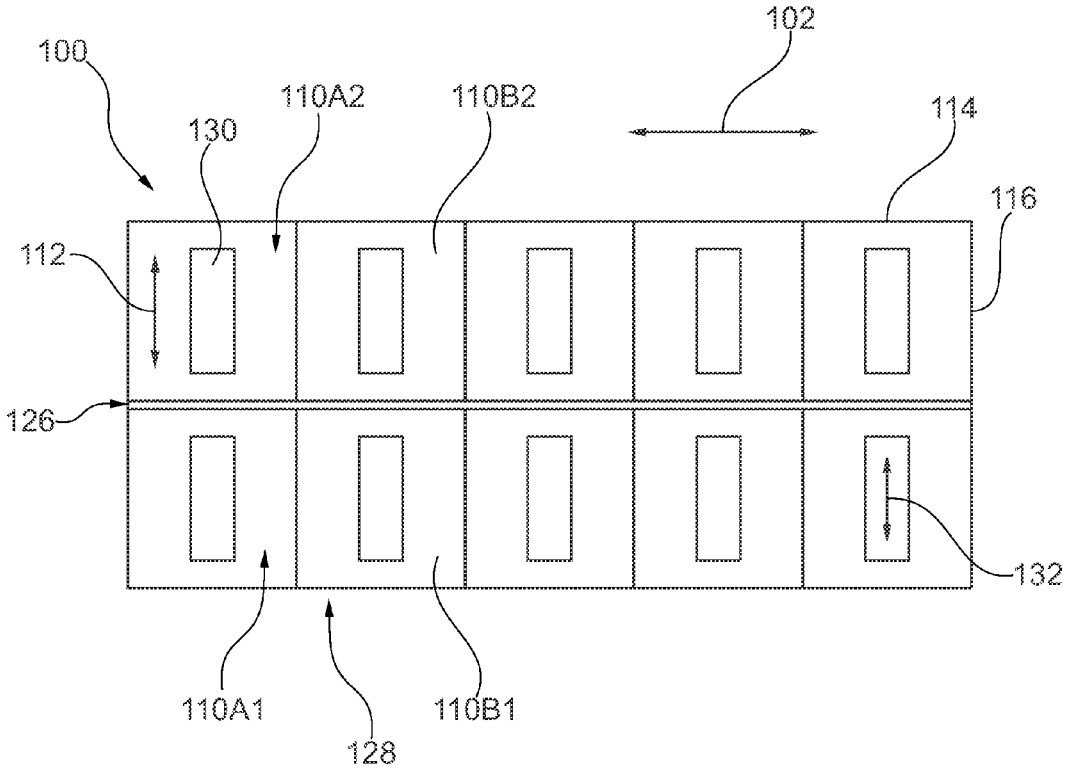
FIG. 1 a top view of a filter consisting of ten dielectric resonators according to an exemplary embodiment.

FIG. 1 shows a dielectric filter 100 in a top view. There are two rows here showing five receiving spaces in each row, respectively 110A1, 110B1, 110A2, 110B2.

A receiving space is a rectangular cavity in the surface of the receiving element, whereby in each receiving space, a dielectric element 130 is disposed.

A longitudinal direction 132 of the dielectric elements 130 extends perpendicularly to the longitudinal direction 102 of the filter. The longitudinal direction 112 of the receiving spaces extends parallel to the longitudinal axis 132 of the dielectric elements 130.

The receiving spaces arranged adjacently in a row in the longitudinal direction 102, for example receiving spaces 110A1 and 110B1 and 110A2 and 110B2, are respectively coupled to the adjacent side surfaces 116 with a longitudinal coupling 128, which for the sake of clarity is not shown in FIG. 1. This is further explained in the following drawings.

The opposing or adjacent receiving spaces in both rows, for example, the receiving spaces 110A1 and 110A2 or 110B1 and 110B2, are coupled to the respective mutually facing side surfaces by a cross-coupling 126. The cross-coupling is more closely illustrated in the following drawings. The receiving space is delimited by the end surface 114 (this is the left surface in FIG. 3A), by the side surface 116 (this is the surface in the plane of the drawing toward the front in FIG. 3A) and by the base 118 (this is the lower surface in FIG. 3A) and the respective opposite surfaces of these surfaces.

Figure 2:
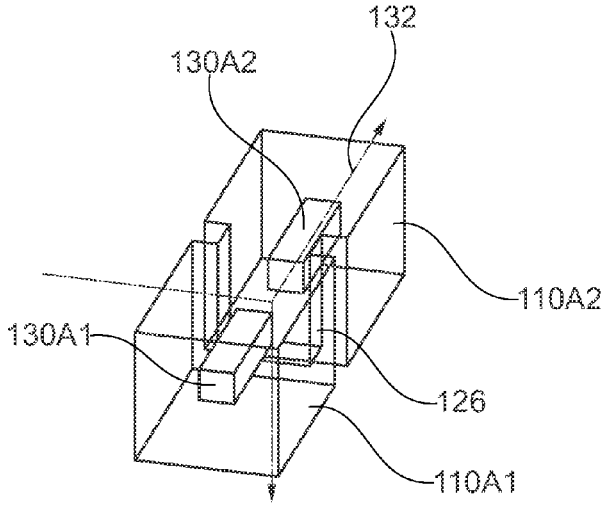
FIG. 2 an isometric illustration of two via cross-coupling coupled receiving spaces of a dielectric resonator according to another exemplary embodiment.

FIG. 2 shows two receiving chambers 130A1, 130A2 of receiving spaces 110A1 and 110A2, respectively, which are connected to each other with a cross-coupling 126. The dielectric elements 130A1, 130A2 are arranged such that their longitudinal axes (i.e., axes in their longitudinal direction 132) overlap or extend coaxially.

The cross-coupling constitutes an opening, which connects the cavities of the receiving spaces 130A1, 130A2 in the direction of the longitudinal axis 132 of the dielectric members.

The cross-coupling is a recess, which based on the receiving member is less deep than the receiving space and whose extension in the longitudinal direction of the filter is shorter than the extension of the receiving spaces in the longitudinal direction of the filter.

The edge lengths of the receiving space vary from a few mm, for example between 2 mm and 12 mm, especially between 3 mm and 8 mm, especially between 4 mm and 5 mm. The edge lengths of the dielectric member between 0.5 mm and 6 mm, especially between 1 mm and 3.5 mm.

A receiving space can, for example, have an edge length of 4 mm in longitudinal direction 102 (FIG. 1) of the filter, a depth also of 4 mm (Depth corresponds to the direction in the plane of projection), and an edge length of 5 mm transversely to the longitudinal direction 102 of the filter.

The dielectric element 130 (FIG. 1) may have an area of 1 mm×1 mm and a longitudinal length 132 of 3.3 mm.

The dielectric element 130 can be spatially arranged centrally or symmetrically with respect to all three spatial axes in the receiving space.

The dielectric element can be held in the target position using a support element. The support element may have particularly low permittivity or dielectric constant. The support element is not shown in the drawings for reasons of clarity. It may be for example, a holding rod, which is mechanically coupled with the dielectric member on the one hand and with a surface of the receiving space on the other, in particular, directly mechanically coupled by means of a cohesive connection, in particular by means a cohesive connection with additional material, for example by using an adhesive bond.

Figure 3A:
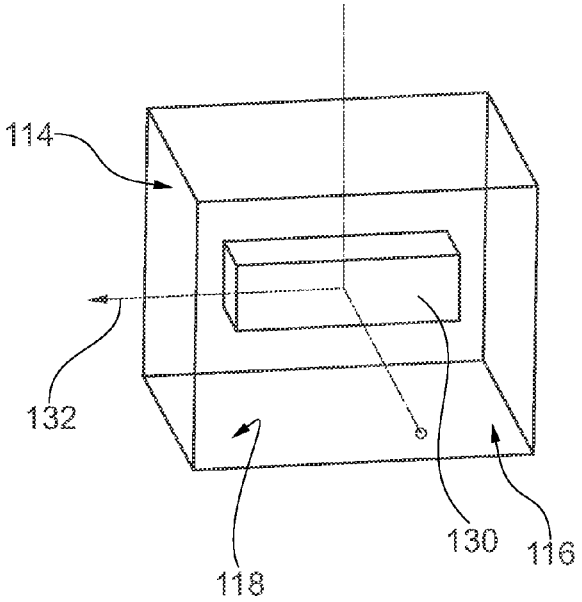
FIG. 3A an isometric view of a receiving space with a dielectric of a dielectric resonator according to another exemplary embodiment.
Figure 3B:
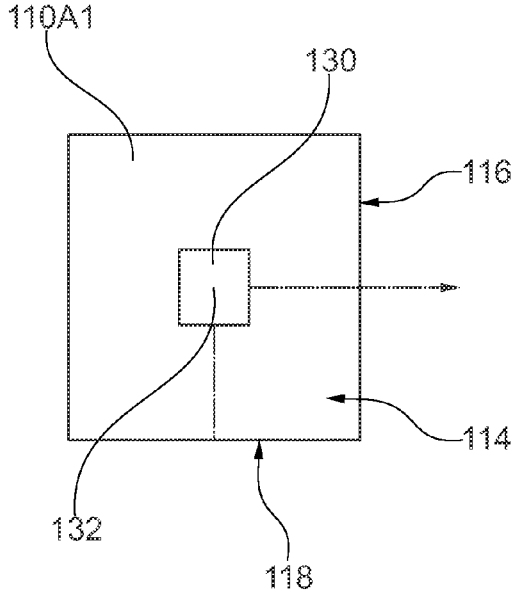
FIG. 3B a side view of the illustration in FIG. 3A.

FIGS. 3A and 3B show an isometric illustration of a receiving space 110A1 (FIG. 3B) with a dielectric member 130 disposed therein along longitudinal direction 132.

The receiving space is delimited by the end surface 114 (this is the left surface in FIG. 3A), by the side surface 116 (this is the surface in the plane of the drawing toward the front in FIG. 3A) and by the base 118 (this is the lower surface in FIG. 3A) and the respective opposite surfaces of these surfaces.

Figure 7:
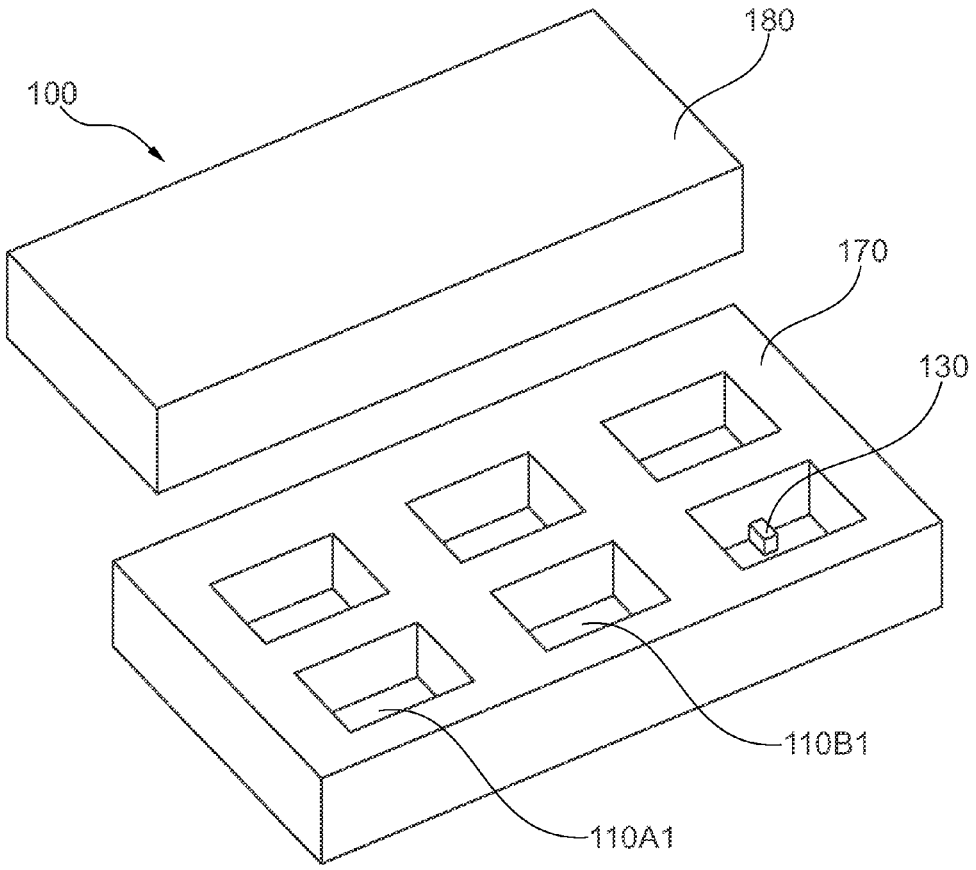
FIG. 7 an isometric illustration of a dielectric filter according to another exemplary embodiment.

Upwardly, thus opposite to the surface 118, the receiving space is delimited by the cover 180 if closed, as is clear in FIG. 7.

It can be seen from drawings 3A and 3B, that the dielectric member 130 on all three axes is arranged centrally in the receiving space.

Figure 4:
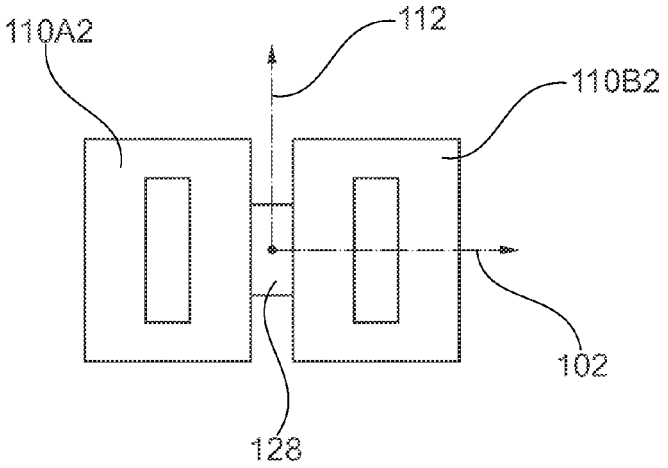
FIG. 4 a top view of an illustration of coupled with longitudinal coupling receiving spaces of a dielectric resonator according to another exemplary embodiment.

FIG. 4 shows a top view of two receiving spaces 110A2, 110B2 coupled with a longitudinal coupling 128. The longitudinal axis of the dielectric members extends in the longitudinal direction 112 of the receiving space and therefore perpendicular to the longitudinal direction 102 of the filter.

Figure 5:
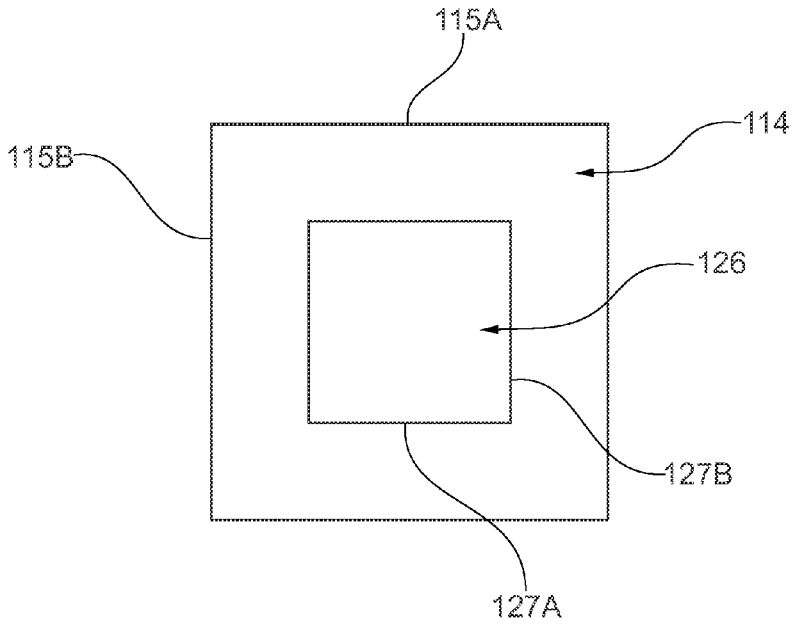
FIG. 5 a schematic illustration of a cross-coupling on a face surface of a receiving space of a dielectric resonator according to another exemplary embodiment.

FIG. 5 shows a stretched end surface 114 of one of the edges 115A, 115B of a receiving space and a stretched cross-coupling 126 disposed therein from the edges 127A, 127B in the form of an opening extending through the end surface 114 in the direction of the adjacent receiving space, in the case of FIG. 5 in the drawing plane.

The cross-coupling can be limited to its upper edge illustrated in FIG. 5 opposite edge 127A of the cover.

The front surface 114 and the cross-coupling 126 are square in this exemplary embodiment.

Figure 6:
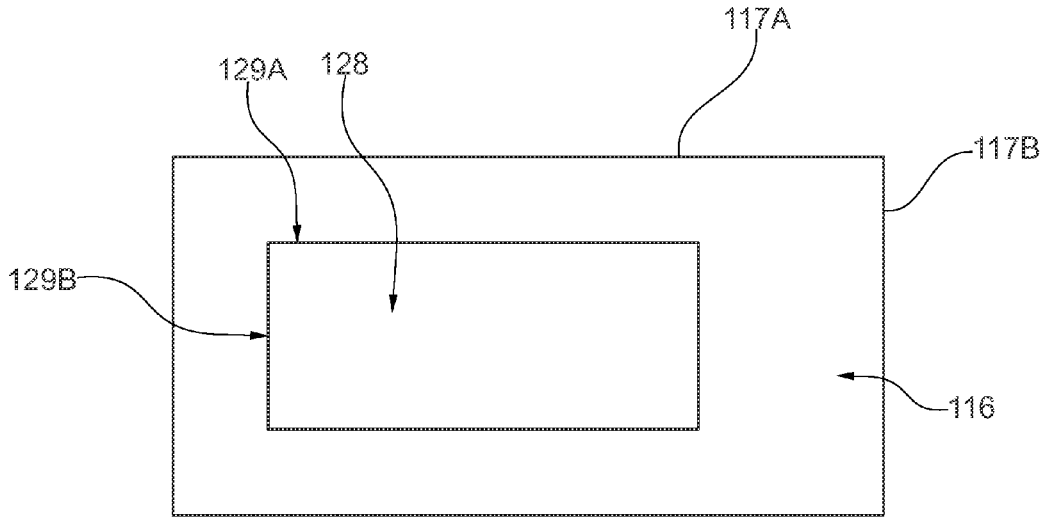
FIG. 6 a schematic illustration of a longitudinal coupling on a side surface of a receiving space of a dielectric resonator according to another exemplary embodiment.

FIG. 6 shows a side surface 116 of a receiving space, which is configured rectangularly, i.e. that the edges 117A, 117B of the side surface 116 are not the same length. The same is true for edges 129A, 129B of the longitudinal coupling 128 arranged in the side surface 116.

In one embodiment, the longitudinal coupling has a different cross-section, while starting from a side surface 129A, 129B projects a single tongue or a single tooth in the direction of the respective opposite side surface, without touching it. The tongue or the tooth may extend in the longitudinal direction of the filter, thus in a direction in the plane of FIG. 7, across the entire depth of the longitudinal coupling. Thus, the longitudinal coupling 128 would receive a ridge or rake shaped cross-section.

FIG. 7 shows an isometric representation of a filter 100 with a receiving member 170 and a cover 180. On a surface of a receiving member the receiving spaces 110A1, 110B1 as cavities are arranged in two rows. In each of the receiving spaces a dielectric member 130 is arranged, whereby in FIG. 7 for reasons of clarity only one of them is illustrated.

The longitudinal and cross-couplings are not explicitly depicted in FIG. 7. However there is longitudinal coupling between all of the receiving spaces in the same row, thus, for example, between 110A1 and 110B1, as a material recess the material bridge separating these receiving spaces. The cross-couplings respectively couple in an analogous manner at the same height the existing receiving spaces from the opposite rows.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A dielectric filter, comprising:

a receiving member having a plurality of receiving spaces;

a respective rectangular dielectric arranged in each of the plurality of receiving spaces such that a longitudinal axis of the respective dielectric is transverse to a longitudinal direction of the dielectric filter; and a cover, which covers the receiving spaces in the receiving member, wherein each of the plurality of receiving spaces is a rectangular cavity, and wherein the longitudinal axis of the respective dielectric is a horizontal axis.

2. The dielectric filter of claim 1, wherein the plurality of receiving spaces are arranged in two rows, and each of the two rows extend in the longitudinal direction of the dielectric filter.

3. The dielectric filter of claim 2, wherein the plurality of receiving spaces arranged in two rows are distributed uniformly in a first row and a second row of the two rows.

4. The dielectric filter of claim 2, wherein a first receiving space and a second receiving space of the plurality of receiving spaces are adjacently arranged next to each other in the longitudinal direction of the filter;

the first receiving space and the second receiving space are coupled to each other via a longitudinal coupling, the longitudinal coupling is a recess connecting the cavities of the first receiving space and the second receiving space with each other.

5. The dielectric filter of claim 2, wherein a first receiving space of the plurality of receiving spaces in a first row of the two rows of receiving spaces and a third receiving space of the plurality of receiving spaces in a second row of the two rows of receiving spaces are arranged adjacent to each other transverse to the longitudinal direction of the dielectric filter so that the first receiving space and the third receiving space are each aligned along the longitudinal direction of the dielectric filter.

6. The dielectric filter of claim 5, wherein the first receiving space and the third receiving space are coupled together via a cross-coupling, the cross coupling is a recess connecting the cavities of the first receiving space and the third receiving space.

7. The dielectric filter of claim 1, wherein the longitudinal axis of each dielectric runs perpendicularly to the longitudinal direction of the dielectric filter.

8. The dielectric filter of claim 1, wherein the longitudinal axis of a dielectric of a first receiving space of the plurality of receiving spaces and the longitudinal axis of a dielectric of a third receiving space of the plurality of receiving spaces extend coaxially with respect to each other, and the first receiving space disposed in a first row of receiving spaces and the third receiving space disposed in a second row of receiving spaces that are adjacently positioned next to one another transverse to the longitudinal direction of the filter so that the first receiving space and the third receiving space are each aligned along the longitudinal direction of the filter.

* * * * *